US005926134A

United States Patent [19]

Pons et al.

[11] Patent Number: 5,926,134

[45] Date of Patent: Jul. 20, 1999

[54] ELECTRONIC SCANNING ANTENNA

[75] Inventors: Patrick Pons, Rueil; Christian Renard, Boulogne, both of France

[73] Assignee: Dassault Electronique, Saint Cloud, France

[21] Appl. No.: 08/813,304

[22] Filed: Mar. 10, 1997

[51] Int. Cl.[6] ..... H01Q 3/22

[52] U.S. Cl. ..... 342/368; 342/375

[58] Field of Search ..... 342/368, 375, 342/371; 343/277

[56] References Cited

U.S. PATENT DOCUMENTS

| | | | |
|---|---|---|---|
| 3,979,754 | 9/1976 | Archer . | |
| 4,276,551 | 6/1981 | Williams et al. . | |
| 4,571,591 | 2/1986 | Valentino et al. | 343/754 |
| 4,845,507 | 7/1989 | Archer et al. . | |
| 5,012,256 | 4/1991 | Maddocks | 343/754 |
| 5,128,687 | 7/1992 | Fay . | |
| 5,357,260 | 10/1994 | Roederer et al. | 343/754 |

OTHER PUBLICATIONS

Hansen, Microwave Scanning Antennas, vol. 1, pp. 224–261, Academic Press, 1964.

Archer, Lens–fed Multiple Beam Array, pp. 171–195, Microwave Journal, Sep. 1984.

Hansen, Microwave Scanning Antennas, pp. 234–257, Peninsula Publishing.

Mailloux, Phased Array Antenna Handbook, pp. 442–445, Aretech House, 1994.

Lo et al., Antenna Handbook Theory, Applications, and Design, pp. 19–36–19–45, Van Nostrand Reinhold Company, New York.

Skolnik, An Introduction to Radar, Radar Handbook, pp. 1.2–1.5 and pp. 20.10–20.11, McGraw Hill, 2nd Edition, 1990.

Brookner, Aspects of Modern Radar, Chapter 2, pp. 48–51 and 54–60, Artech House, 1988.

R. Collin et al., Antenna Theory, Part 2, pp. 126–150, McGraw Hill, 1969.

*Primary Examiner*—Gregory C. Issing

*Attorney, Agent, or Firm*—Pollock, Vande Sande & Amernick

[57] ABSTRACT

A two-directional network antenna includes N parallel and juxtaposed arrays of antenna elements respectively connected to electronic transmission/receiving circuits by an ultrahigh frequency connecting device with phase shifts controlled by a control device. The ultrahigh frequency connecting device comprises N transmission lines respectively associated with N arrays of antenna elements, each transmission line having outputs in propagation lengths which are staggered in relation to their input, which outputs are connected to respective antenna elements of the associated array. The ultrahigh frequency connecting device further comprises at least one electromagnetic lens with P inputs and N outputs respectively connected to N inputs of the transmission lines. The control device comprises switching elements for selecting at least one of the P inputs of the electromagnetic lens to provide scanning in one direction, and elements for causing the frequency of the signals applied to the selected input to vary, to provide scanning in a second, perpendicular direction.

11 Claims, 8 Drawing Sheets

ELECTRONIC SCANNING ANTENNA

BACKGROUND OF THE INVENTION

1. Field of the Invention

The invention relates to the field of electronic scanning antennas.

2. Description of Related Art

Conventionally electronic scanning is obtained by means of a network antenna, each element of which is provided with a respective controlled phase shifter (or with a line of programmable length). The adjustment of the phase shifts makes it possible to aim the beam of the antenna in any desired direction within a two-dimensional angular field, defined in relation to two perpendicular planes which are frequently two planes of symmetry of the antenna.

For some applications, (antennas that are transmitters and receivers at the same time), the phase shifters must be reciprocal; this means that the phase shift is the same for the transmitted signals and for the received signals which travel in the phase shifter in a direction opposite to the first.

These technologies are well tried, but they are complex and onerous in a way that rapidly increases with the size desired for the antenna. It follows from this that the electronic scanning cannot be used in applications where it would, nevertheless, be worthwhile.

Apart from conventional phase shifters, other means have been envisaged, without so far having been capable of giving really satisfactory results.

BRIEF SUMMARY OF THE INVENTION

The present invention aims to improve the situation.

The proposed device is of the known type comprising: a two-dimensional network antenna, that can be broken down into N parallel and juxtaposed arrays of antenna elements; ultrahigh frequency connecting means with controlled phase shifts, for connecting the antenna elements to electronic transmission/receiving circuits; and phase control means capable of acting on the phase shifts with a view to modifying the diagram originating from the network antenna, in particular as regards direction.

According to the present invention there is provided an ultrahigh frequency antenna device with electronic scanning, of the type comprising:

a two-dimensional network antenna, that can be broken down into N parallel and juxtaposed arrays of antenna elements, ultrahigh frequency connecting means with controlled phase shifts, for connecting the antenna elements to electronic transmission/receiving circuits, and phase control means, capable of acting on the phase shifts with a view to modifying the diagram originating from the network antenna, in particular as regards direction, wherein said ultrahigh frequency connecting means include:—on the one hand N transmission lines respectively associated with N arrays of antenna elements, each transmission line having outputs in propagation lengths staggered in relation to their input, which outputs are connected to the respective antenna elements of the associated array; and on the other hand at least one electromagnetic lens with P inputs and N outputs, respectively connected to N inputs of the transmission lines; and wherein the phase control means comprise:—on the one hand switching means for selecting at least one of the P inputs of the electromagnetic lens, and on the other hand means for varying the frequency of the signals applied to the selected input.

BRIEF DESCRIPTION OF THE DRAWINGS

Other characteristics and advantages of the invention will become apparent on examining the detailed description given below, and the accompanying drawings, wherein.

The accompanying drawings are at least partly of a definitive nature. Consequently they form an integral part of the description and may serve not only for a better understanding of the latter but also to contribute to the definition of the invention if required.

DETAILED DESCRIPTION OF THE INVENTION

An antenna with mechanical scanning has several drawbacks; in particular it has: a variable and considerable response time in the case of a jump in direction, and supply difficulties for high frequencies of several tens of Gigahertz.

Electronic scanning may be effected in only one of the bearing and azimuth directions. The other direction is then subject to zero or predetermined phase shifts. In this case, it frequently happens that the network antenna is broken down into N parallel and juxtaposed arrays of antenna elements (it being possible for the total number of radiating elements necessary for the application chosen to vary from one array to another). An array of antenna elements is frequently called a bar.

The conventional solution lies in associating a phase shifter and its control circuit with each antenna element. It poses topological problems, the resolution of which is fairly well known by means of unidirectional (or unidimensional) scanning.

In this case other solutions have been envisaged such as electromagnetic lenses, or Butler matrices (cascades of couplers) which are based on the changeover of the propagation time of the wave to ensure the phase shift, and only permit unidirectional scanning.

There exist several types of electromagnetic lenses, amongst them Rotman lenses, Luneberg lenses, so-called R2R lenses, or yet again those termed "RkR" (see "Lens-fed multiple beam array", D. M. ARCHER, Microwave Journal, September 1994, pp 171–195; "Microwave scanning antennas", R. C. HANSEN, vol. 1, 1964, Academic Press, pp. 224–261; "Antenna Theory", R. COLLIN, F. ZUCKER, part 2, chapter 18, McGraw Hill, 1969, pp. 126–150).

Scanning known as frequency scanning has also been envisaged ("Radar handbook", Skolnik, McGraw Hill, 2nd edition, 1990, pages 20.10 to 20.11). It also starts with the propagation time which is staggered, but without switching, and in this use it is by way of a frequency variation that the phase shift is obtained. This proposal also permits only unidirectional scanning. It has other technical constraints which restrict its use.

As for two-directional scanning, the solutions used in practice so far comprise phase shifters, even though the above mentioned problems of topology there become particularly difficult to resolve. Thus the combination has been proposed of frequency scanning in one direction, and of scanning by phase shifters in the other (see "Phased array antennas", A. OLINER, G. KNITTEL, Artech House, 1972, pp. 198–200; "Aspects of modern radars", E BROOKNER, Artech House, 1988, chapter 2, pp 47–51 and 54–60).

Figure 1:
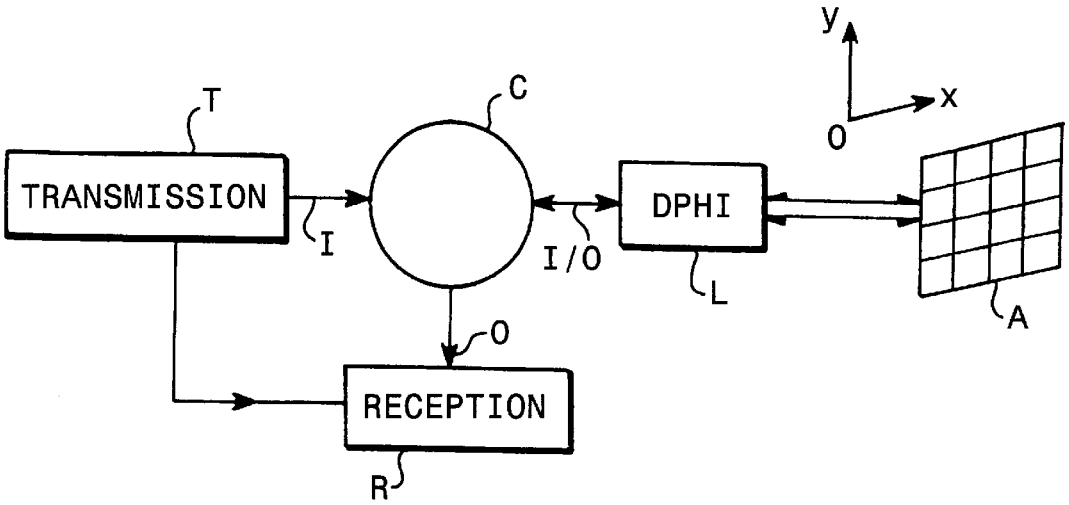
PRIOR ART FIG. 1
FIG. 1 is a general schematic diagram of a radar with electronic scanning.

Reference will now be made to FIG. 1 which describes the general structure of a radar device to which the invention can be applied.

An input I of a duplexer such as a circulator C receives the output of a transmission circuit T. The output O of the circulator passes towards a receiving circuit R. The input/output I/O of the circulator passes to the connecting means L with a phase shift which "feeds" an antenna A in a directional mode where two axes Ox and Oy are distinguished. Data regarding the transmission frequency are transmitted from the transmission circuit T to the receiving circuit R.

Figure 2:
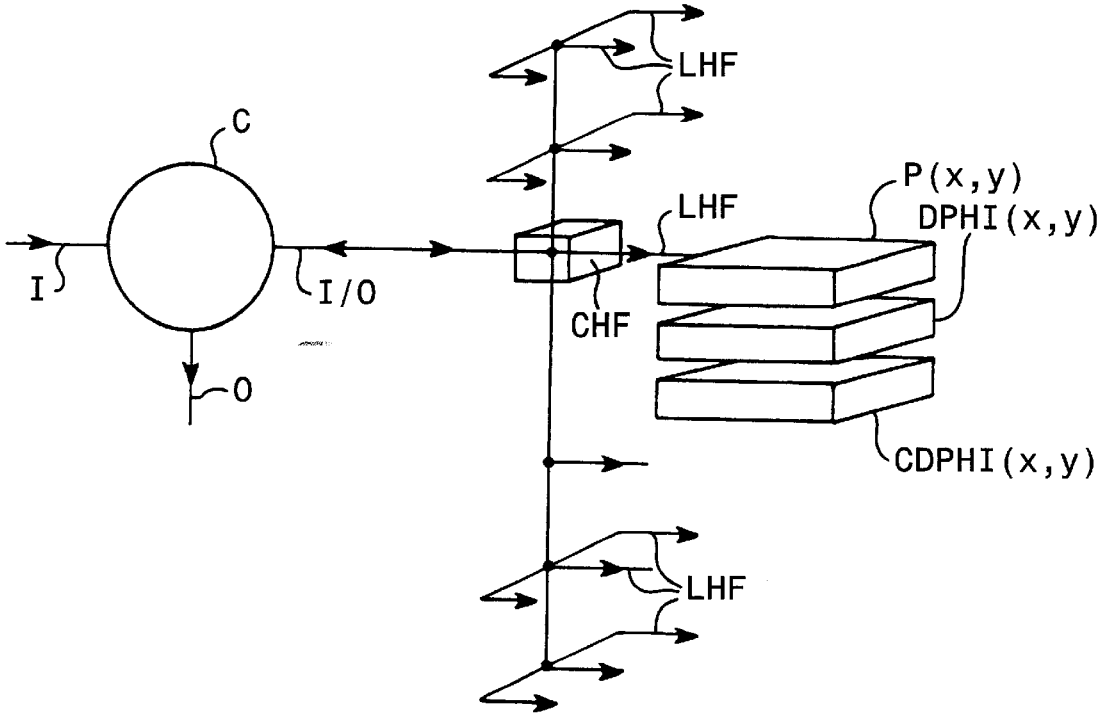
PRIOR ART FIG. 2
FIG. 2 illustrates in a more detailed manner the installation of a conventional phase shifter with its control circuit.

The schematic diagram of the conventional solution with a phase shifter is given in FIG. 2. The output of the input/output I/O of the circulator C is broken down, for example by 3 db couplers CHF, into a plurality of ultrahigh frequency lines LHF. In this conventional solution, each line is coupled to one element of the antenna A. FIG. 2 shows only one of these elements P(x, y), accompanied by the phase shifter CDPHI (x, y), and of its control circuit CDPHI (x, y).

It is recalled that ultrahigh frequency connections are more difficult to obtain than low frequency electrical connections.

An examination of FIG. 2 shows that the creation of two-directional scanning, where each antenna element is accompanied by two other rather bulky elements, poses difficult installation and connection problems at the network antenna A.

This is why in many applications electronic scanning is only undertaken in one single direction or along one single dimension.

The present invention is based in particular on the observation that it is possible to distinguish completely the phase rules that are desired, according to the two directions Ox and Oy.

Figure 3:
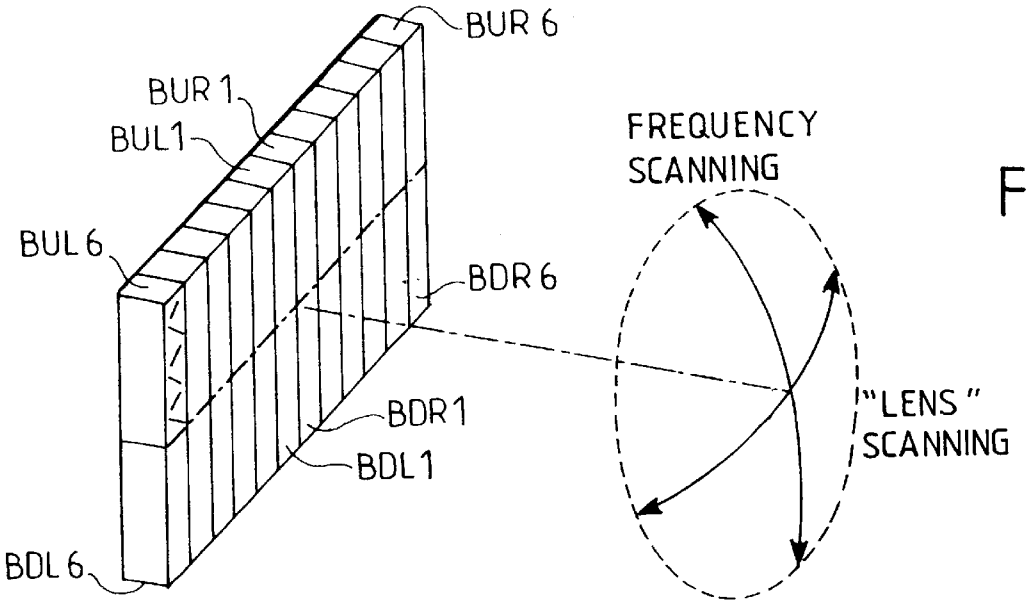
FIG. 3 illustrates an example of a network antenna according to the invention.

The proposed antenna is schematically outlined in FIG. 3. In one embodiment, it is constituted by vertical bars of antenna elements, juxtaposed along a horizontal row. The antenna illustrated is, moreover, divided into four quadrants. The upper left quadrant is constituted by half-bars Bul1 to Bul6; the lower left quadrant is constituted by the half-bars Bdl1 to Bdl6; the upper right quadrant by the half-bars Bur1 to Bur6, and the lower right quadrant by the half-bars Bdr1 to Bdr6.

A half-bar is understood to mean a bar equipping one quarter of an antenna quadrant. Therefore in the following discussion of the description, a half-bar may be likened to a bar.

Each bar here has six antenna elements (in fact, many more), as illustrated by the six slots which are represented on the bar Bul6. In this example, the slots have alternating inclinations; according to the electrical length 'a' (FIG. 4), it is also possible to provide slots that are all inclined in the same direction.

FIG. 3 shows, moreover, that electronic scanning by an electromagnetic lens will be used in the horizontal direction, and in a "frequency" mode, that is to say by frequency variations, in the vertical direction.

In a particular application, the variation of aiming angle in the elevational mode ranges from −10° to +20°. The variation of aiming angle in the bearing (azimuth) mode ranges from −60° to +60°. The characteristics desired for the beam emitted by the antenna are an aperture angle at half power of 2° in the bearing mode and of 4° in the elevation mode.

Figure 3B:
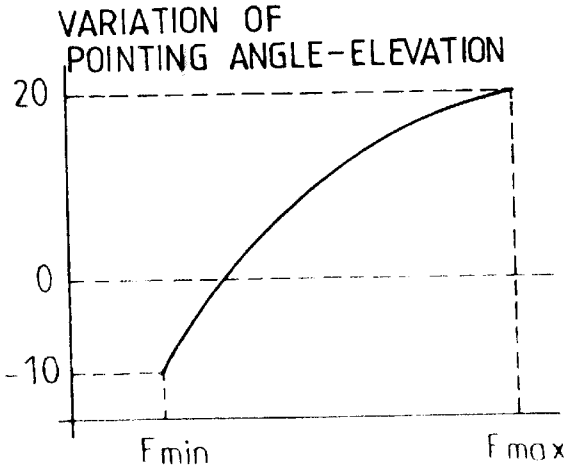
FIGS. 3A and 3B are diagrams illustrating a scanning rule obtained in the "frequency" mode.
Figure 3A:
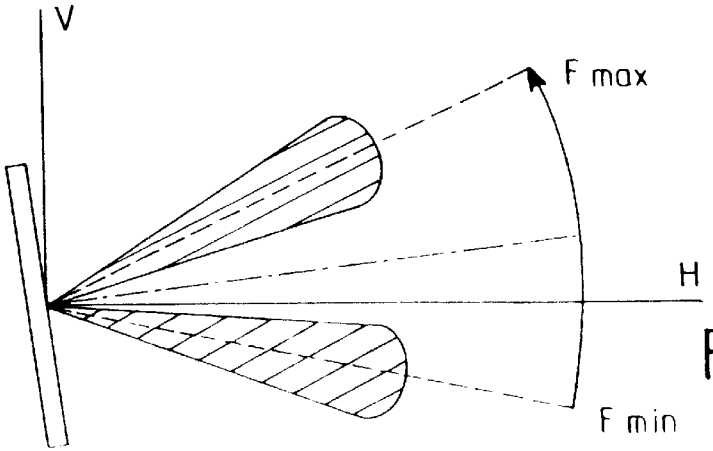

The FIGS. 3A and 3B, which correspond to each other, show that vertical scanning from −10° to +20° is obtained by varying the frequency between Fmin and Fmax.

Figure 4:
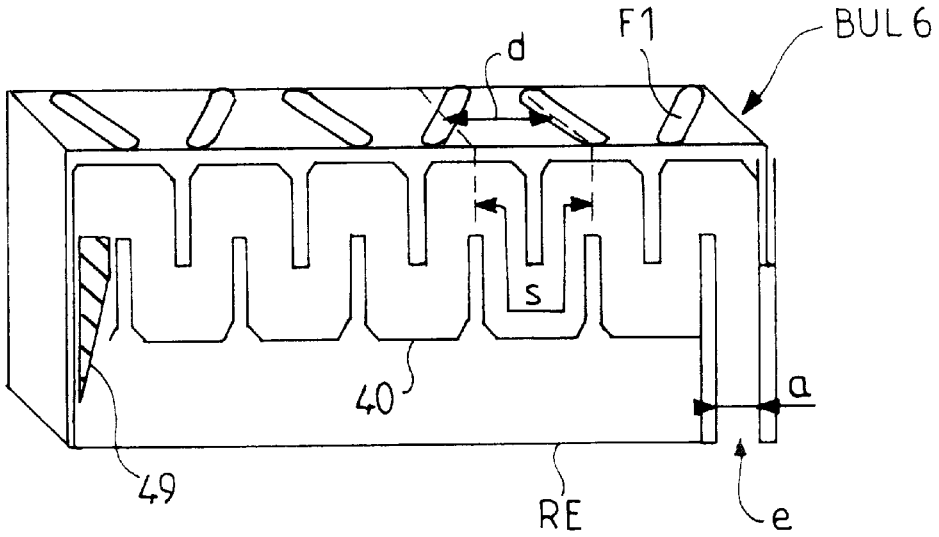
FIG. 4 illustrates a "serpentine" type of propagation line.

In the example of the half-bar Bul6, FIG. 4 shows a serpentine staggered microwave distributor Re, bearing the reference numeral 40. From an input e of size a, the serpentine is composed of consecutive meanders such as those illustrated, whereof each upper portion is directly connected to one of the slots, such as F1, forming a radiating element of the half-bar Bul6. A path s is passed through by the electromagnetic radiation between two consecutive slots, while the centers of the slots are interspaced by d, for a section a at the input e of the distributor Re. The slots have alternating inclinations. Finally, at its other end, the serpentine wave guide is closed by an absorbing charge 49 which prevents any reflection of the ultrahigh frequency energy.

Figure 5A:
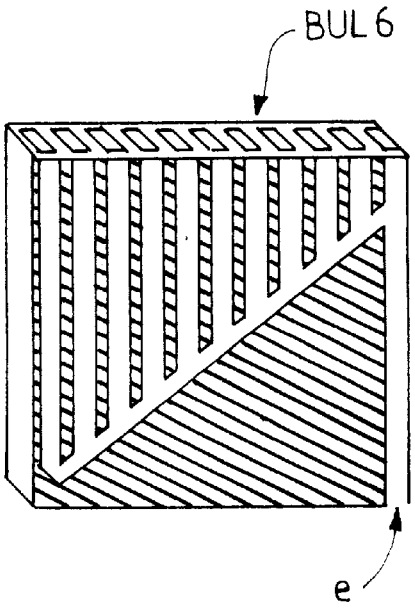
FIGS. 5A to 5D illustrate variants of an "arborescent" type propagation line.
Figure 5B:
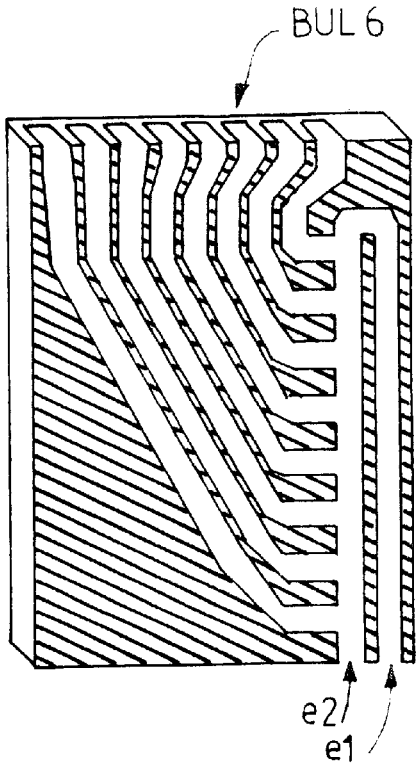

FIGS. 5A and 5B illustrate two other variants of the embodiment wherein the radiating elements of the half-bar are still constituted by slots but which are, this time, parallel to one another. These slots are defined at the ends of the wave guide which are formed in the way shown, and which join a supply line e (FIG. 5A) or e1 (FIG. 5B). Such structures are known under the name of "ARBORESCENT", or yet again "CORPORATE" distributors.

Figure 5C:
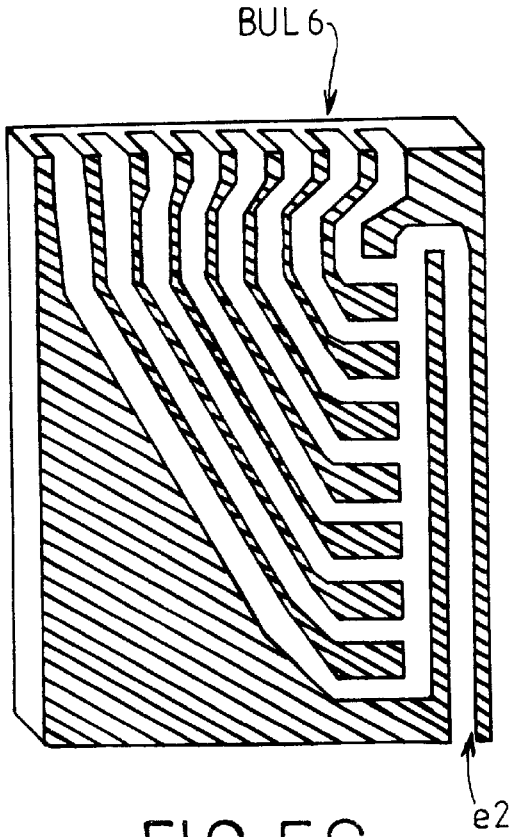

In FIG. 5B, there is shown a second intake e2 which makes it possible to excite the staggered transmission line by benefitting from a different temporal staggering rule; if this possibility is not used, the second intake e2 may be obturated in a suitable way (FIG. 5C).

Figure 5D:
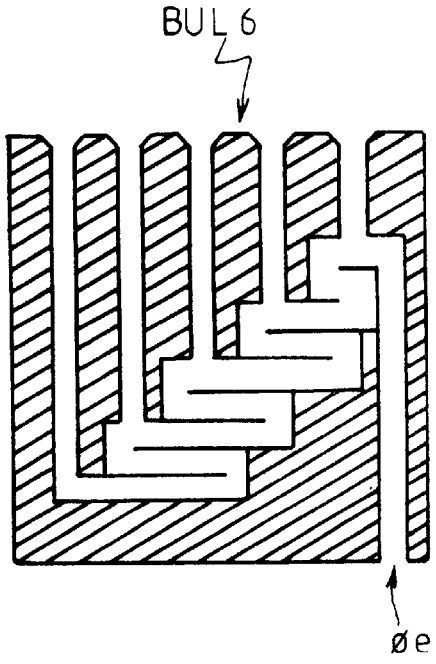

Another variant is illustrated in FIG. 5D.

The examples given in FIGS. 4, 5A and 5B illustrate three ways of obtaining a staggered transmission line having outputs in propagation lengths staggered in relation to the input, each output being coupled to one radiating element. In the three embodiments illustrated, these outputs themselves constitute the radiating slots.

The technology used for the embodiments of FIGS. 4 and 5A to 5D is of the wave guide type. It is clear that these patterns are transposable in the form of printed circuits: serpentine or corporate lines as microstrips, in a three-plate technology ("stripline"), or with a suspended substrate ("suspended stripline"), coupled with radiating elements of the dipole, patch or slot type, for example.

The choice of the technology depends mainly on the frequencies in use, with the loss characteristics, manufacturing tolerances, cost, size, weight deriving therefrom, as well as the energy level and the environment.

Figure 6A:
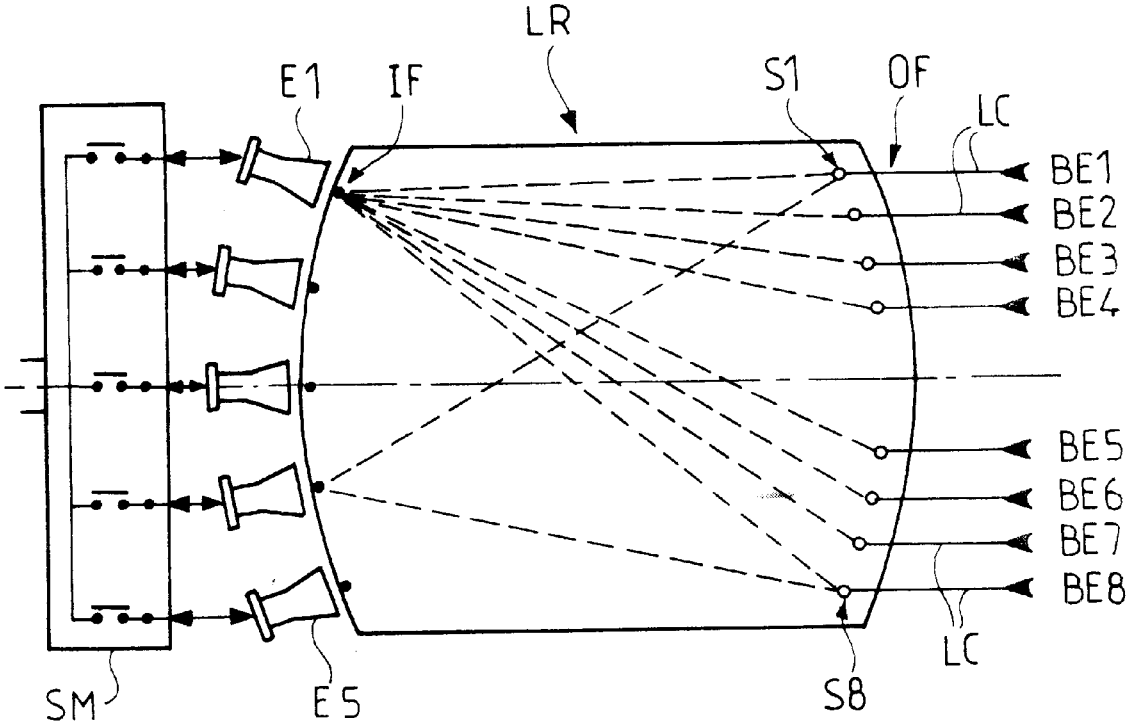
FIGS. 6A and 6B illustrate respectively in a top view and in perspective an electromagnetic lens called a Rotman lens.

FIG. 6A shows a Rotman lens LR which is an electromagnetic means whose function is similar to that of optical lenses. In the example illustrated, the Rotman lens LR comprises 5 inputs E1 to E5 (FIG. 6A), as well as 8 outputs S1 to S8, which are each presumed to be connected via a line LC to bars BE1 to BE8, each comprising a plurality of radiating elements, as illustrated in FIGS. 4 and 5, the lines LC having different lengths.

Of course, the number of inputs and of outputs may be different from that illustrated. Thus a beam of 2° over a scanning range +/−60° (that is to say 120°) leads to approximately 40 inputs (where 40=120°/3°; 3° being the mean value between the width of the beam in the axis (2°) and that of the beam with an aiming variation of 60° (4°=2°/cos (60°))). The number of outputs is related to the number of bars to be supplied, which depends on the width of the desired beam.

The special feature of the Rotman lens is that each one of its inputs E1 forming as it were a focus, feeds the outputs S1 to S8 with a set of well-determined respective propagation periods, which focus varies from one input to another. Thus the input E1 feeds the outputs S1 to S8 with a first set, while the input E4 does the same for the said outputs, but with a different fourth set of the respective propagation periods. This is again the same for the input E8, once again with an eighth set of propagation times that is different from the preceding ones. Moreover, because of the focusing properties of the system, the variations of these propagation periods are directly sufficient to control the elements of a network antenna for the purpose of a direction control.

Thus by switching the microwave energy applied to the input by means of a switching matrix SM, one can choose one of its inputs E1 to E5 of the electromagnetic lens LR, and therefore choose the respective phase rules of the different outputs S1 to S8, and hence the aiming direction of the antenna.

One of the special features of electromagnetic Rotman lenses is that the phase jumps (or jumps of the phase rule) are there basically effected by discrete values. Another special feature is that it is possible to feed several inputs Ei simultaneously (i=1 to 5).

Thus the phase control obtained by means of a Rotman lens is effected by means of a switching matrix SM capable of connecting to its input ESM any one of the inputs E1 to E5 of the lens LR. Moreover, it is possible to feed several inputs Ei (i=1 to 5) simultaneously.

Figure 6B:
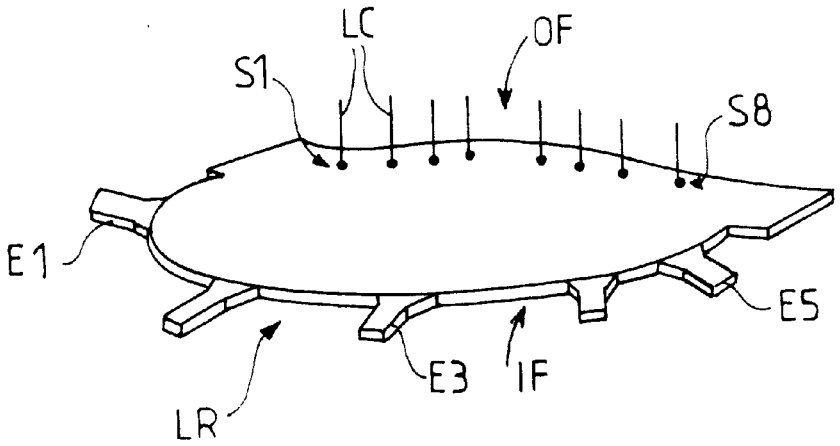

The general structure of a Rotman lens LR is schematically illustrated in FIG. 6B.

Such a lens is, in essence, constituted by two parallel plates shaped and spaced from each other by a distance less than the operating half wavelength, while forming a box provided with openings (5 in the example illustrated) on a front side face IF which has a predetermined curve, as well as passageways in the region of a rear side face OF, which permit the introduction of coaxial probes (one per output) which are respectively connected to the inputs of the bars, or of the radiating elements when there is no bar. The rear side face OF has a curve in the shape of a "focal arc".

Each opening may be provided with an input horn which constitutes a natural transition between a wave guide environment and the Rotman lens with parallel plates.

Of course, it will be possible to use wave guide horns at the output and coaxial probes at the input.

In such a lens (cf. R. J. MAILLOUX: "Phased array antenna handbook", Artech House, 1994; and LO, LEE: "Antenna handbook", Van Nostrand Reinhold, 1988), each beam or input signal coming from an input horn is substantially focused on each of the coaxial probes which are distributed over the focal arc of the rear side face.

The preceding discussion is a schematic basic description of the means of the invention.

There will now be given two more detailed examples of the embodiment.

Figure 7:
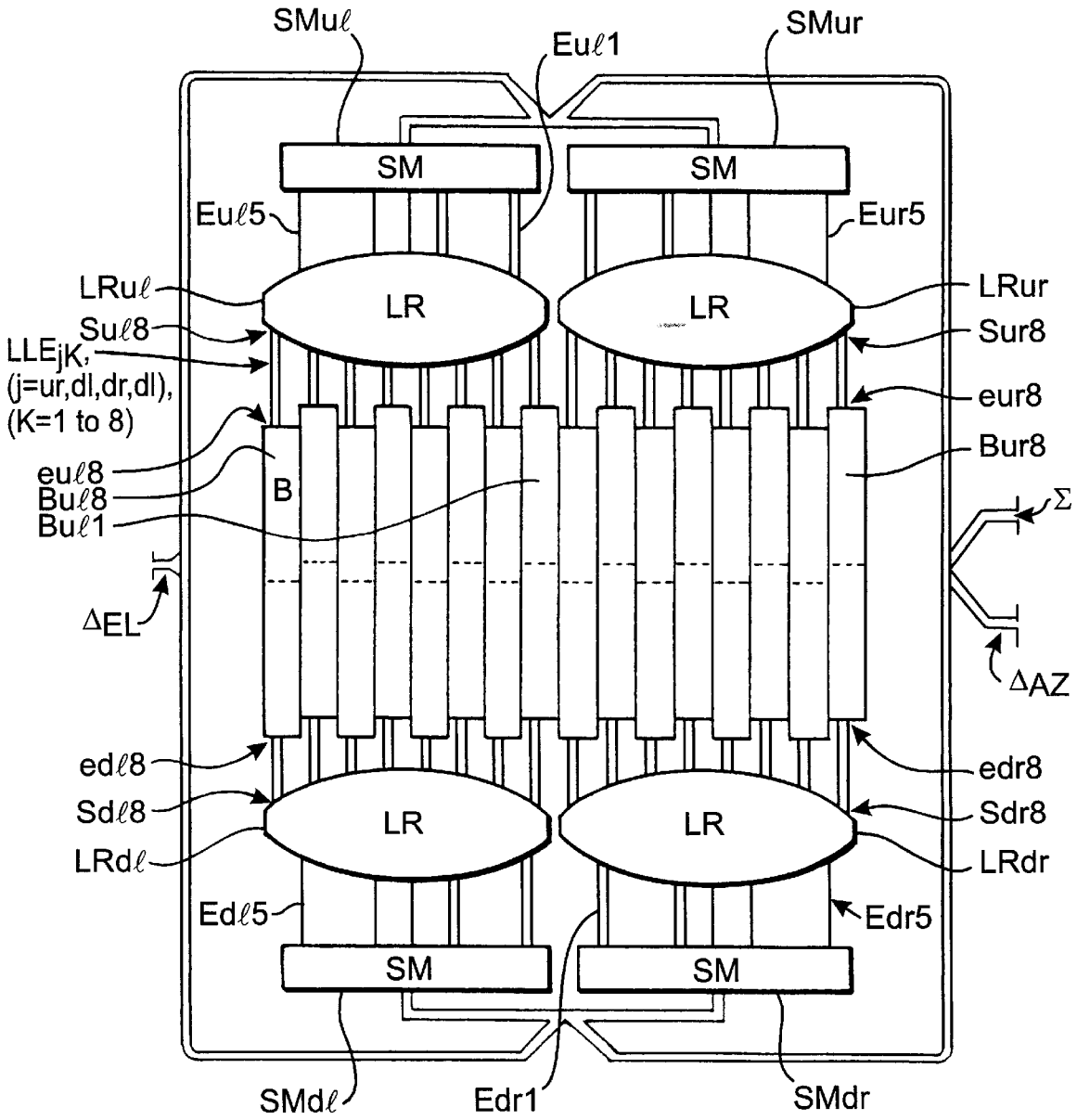
FIGS. 7 and 7A illustrate a first embodiment of the invention.

These refer to an antenna with four quadrants such as illustrated in FIGS. 3 or 7. Each one of the four quadrants has a switching matrix SMj (j=ur, ul, dr, dl), a Rotman lens LRj whose inputs Eji are respectively connected to the outputs of Smj, and, for each output Sjk (k=1 to 8) of the Rotman lens Lrj, a line of staggered length LLEjk feeding a bar Bjk.

Thus for the upper right portion, the assembly comprises a switching matrix SMur, feeding the inputs Euri of a Rotman lens LRur whose outputs are in turn connected to staggered connections (not shown herein), for the half-bars Bur1 to Bur8 (limited in the chosen example to 8 whereas several tens of bars are used in practice). The same applies to the upper left portion (suffix "ul"), to the lower right portion (suffix "dr"), as well as to the lower left portion (suffix "dl"). To prevent the drawings from being overloaded unnecessarily, not all of the elements bear reference numerals.

Ultrahigh frequency connections start from the four switching matrices Smj to allow a sum signal Σ, as well as, on the one hand, a difference ΔAZ in azimuth (bearing) and on the other hand, for example, a ΔEL type signal, that is to say a difference in elevation (elevation angle).

Figure 7A:
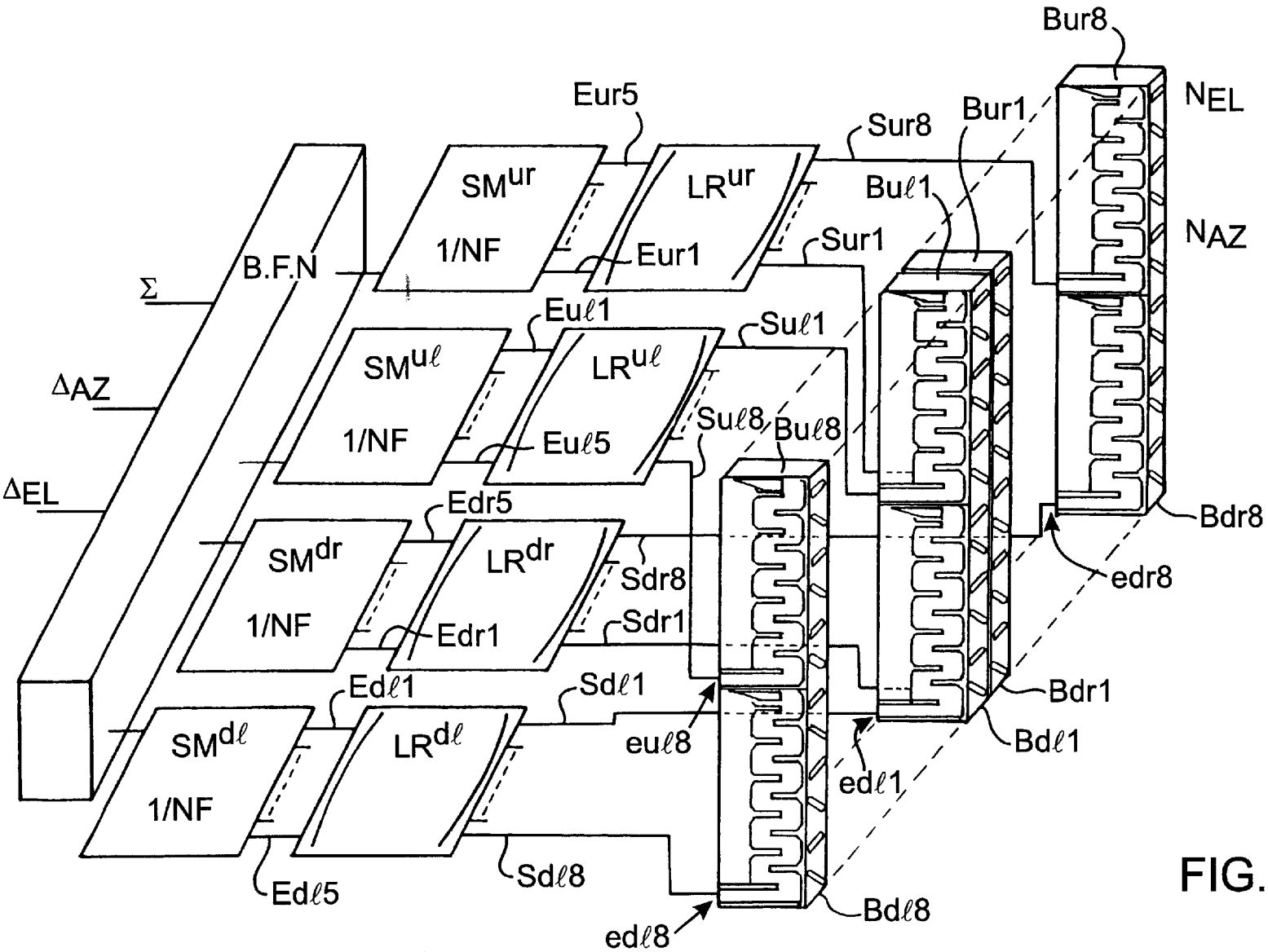

FIG. 7A illustrates the layout in a three-dimensional form to allow it to be more readily understood.

In FIG. 7A, only the central half-bars BUl1, Bur1, Bdr1 and Bdl1, and the end half-bars Bur8, BdrB, Bdl8, Bul8 have been illustrated. A Rotman lens Lrur has different outputs connected to the inputs of the staggered lines (here of the serpentine type, as illustrated in FIG. 4), of the half-bars Bur1 to Bur8. A Rotman lens LRul does the same for the upper half-bars Bul1 to Bul8. In the bottom portion, the Rotman lens LRdr feeds the inputs of the serpentine guides of the half-bars Bdr1 to Bdr8, and finally, a Rotman lens LRdl does the same for the half-bars Bdl1 to Bdl8. The inputs of these four Rotman lenses are fed through switching matrices designated Smur, SMul, SMdr and SMdl respectively, which makes possible the choice of an input from NF, or possibly the choice of several inputs (in the example NF=5, but in reality, this number is much higher) recalling that these NF inputs correspond to NF respective beam directions. Finally, a unit for forming beams BFN ("Beam Forming Network") makes it possible to obtain, for example, the three signals comprising the sum, the difference in azimuth, and difference in elevation, as illustrated by the conventional abbreviations for this purpose.

Figure 8:
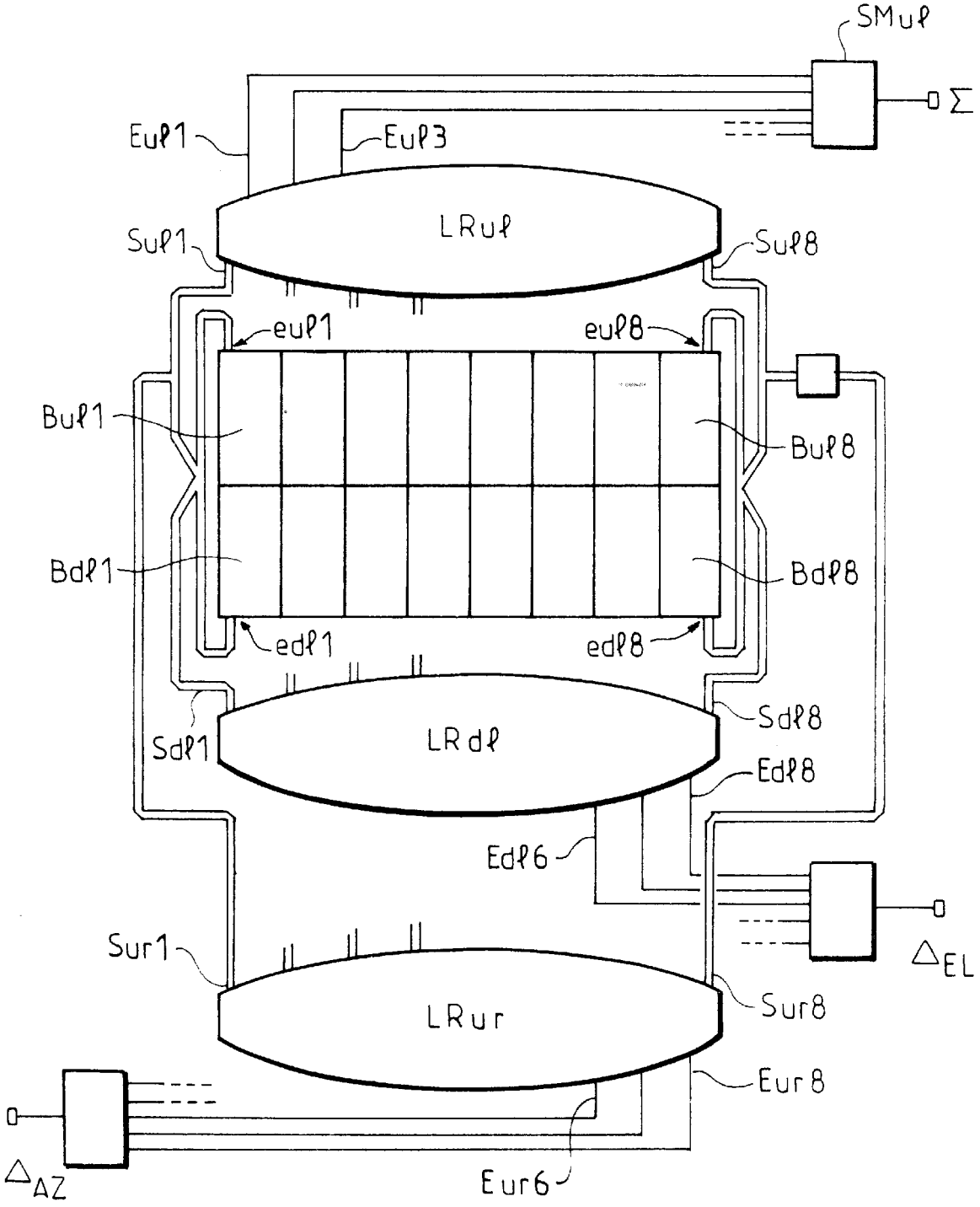
FIG. 8 illustrates a second embodiment of the invention.

Different types of transpositions may be effected in the operation of the invention. One of these is illustrated in FIG. 8 where the elements for forming the beams, that is to say, the creation of the sum signal and of the difference signal or signals, intervene directly in the connection between each Rotman lens and the staggered transmission lines.

In this case, there are as many Rotman lenses as there are desired combinations for such signals in the beam formation mode. The switching matrices remain ahead of the Rotman lenses.

The input of each half-bar is connected to an output of each of the Rotman lenses (only 3 in the example illustrated in FIG. 8) by means of "magic T"-type couplers. To simplify the drawings, these connections have only been shown for the end bars. Similarly, in this FIG. 8, only three inputs and two outputs fitted with magic Ts on each Rotman lens have been shown, but it is clear that in reality, there are as many inputs as there are output beams, and as many outputs as there are half-bars.

Although the invention admits various applications, it is particularly suitable for applications of short-distance monitoring radars, in particular, for example, for an airport monitoring radar where one is operating within a single repetition frequency. These radars frequently require a two-directional (or "two-plane") scanning of their beams, for which the invention provides a particularly neat operation.

The processing of the corresponding radar signal requires an adaptation of the signal to this type of scanning, whose essential parameters are the instantaneous band of the signal for the signal processing proper which depends on the desired resolution and may be rather wide, as well as on the agility for aiming the beam.

By choosing the difference of the electrical length between the elements of one bar (designated s in FIG. 4) in an adequate manner, it is thus possible to reconcile the following requirements:

- the aiming direction for an object is obtained by a choice of frequencies in elevation, and by the choice of access to each Rotman lens (bearing graph);
- in the direction of the observed object, the variation in aiming the radar in the instantaneous band does not exceed the half-aperture at half power of the beam; this variation entails, moreover, a reduced amplitude fluctuation in the object in the desired direction. Indeed, for frequency scanning, it is desirable for the variation of the aiming direction due to the shape of the transmission wave not to exceed half the angular aperture of the antenna beam.

It is possible to avoid problems with possible third transmissions, by proceeding as indicated below:

- in a wideband mode it is not possible to allocate several sub-bands to the same aiming direction, but it is on the other hand possible to program random scanning figures (in elevation) translated as random jumps in frequency;
- in a narrow band mode, it is possible to cause the same aiming direction (in elevation) to correspond to several regularly spaced-out sub-bands; it is then possible to proceed with the frequency excursion on one channel chosen from several aiming at the same point.

The invention is not limited to the examples of the embodiment described.

One may in particular envisage scanning over a complete rotation (360°) in the bearing or azimuth mode, accompanied by a frequency scanning in elevation. This may be obtained by means of a cylindrical or frustoconical network antenna; the bars of the network may be vertical in the case of a cylindrical network or be inclined in the case of a frustoconical network, and be in all cases arranged on a circle along which frequency scanning is undertaken.

The switching of the beams over 360° may be effected by a Luneberg lens (the above mentioned publications "Microwave scanning antennas" and "Antenna Theory"). In this way, modifications of the aperture of the beam at half power according to the variation of aiming in the bearing mode do not appear.

It is also possible to effect scanning over a limited bearing sector, as well as frequency scanning in elevation. This may be undertaken by providing vertical or inclined bars disposed over a circular portion.

The switching of the beams may also be effected by R2R or RkR lenses (See "Lens-fed multiple beam array", "Microwave scanning antennas" and "Antenna Theory"). Here too, there are no modifications of the aperture of the beam at half power with a variation of pointing in azimuth (bearing) because, in contrast to a planar network, the radiating network appears in an identical aspect irrespective of the direction along which it is examined.

The invention makes it possible to create antennas with a large number of elements operating in the high frequency mode (several tens of Ghz), by avoiding the problems of cost, of complexity and of difficult installation, both as regards the connection, the mechanics and the heat technology to which the previously known solutions were subject.

The antenna described above is operated with vertical bars installed along a horizontal row. It is, of course, possible to do the opposite. Similarly, it is not necessary for all the bars to have the same number of radiating elements, nor for the radiating elements of each bar to be disposed in a completely regular manner.

We claim:

1. An ultrahigh frequency antenna device for electronic scanning in first and second perpendicular directions, comprising:

a two-dimensional network antenna, including N parallel and juxtaposed arrays of antenna elements, ultrahigh frequency connecting means with controlled phase shifts, for connecting the antenna elements to electronic transmission/receiving circuits, and control means, for controlling the phase shifts to modify the radiation pattern originating from the network antenna, including its direction, wherein said ultrahigh frequency connecting means include:

N transmission lines respectively associated with N arrays of antenna elements, each transmission line having outputs in propagation lengths staggered in relation to their input, which outputs are connected to the respective antenna elements of the associated array; and at least one electromagnetic lens with P inputs and N outputs, respectively connected to N inputs of the transmission lines; and wherein the control means comprise:

switching means for selecting at least one of the P inputs of the electromagnetic lens, to provide said controlled phase shifts for scanning in said first direction; and frequency control means for varying the frequency of the signals applied to the selected input, for scanning in said second direction.

2. A device according to claim 1, wherein the transmission lines of a staggered length are serpentine.

3. A device according to claim 1, wherein the transmission lines of a staggered length are arborescent.

4. A device according to claim 1, wherein the transmission lines are placed at each array of antenna elements.

5. A device according to claim 1, wherein the transmission lines include wave guides.

6. A device according to claim 1, wherein the transmission lines are obtained by means of printed circuit technology.

7. A device according to claim 1, wherein the antenna elements are of the slot or radiating aperture type.

8. A device according to claim 1, wherein the antenna elements are of the dipole, patch or slot type, obtained in a printed circuit technology.

9. A device according to claim 1, wherein the network antenna comprises two half-antennas supplied by separate electromagnetic lenses.

10. A device according to claim 9, wherein the network antenna comprises four quadrants, supplied by four separate electromagnetic lenses associated with four respective switching matrices.

11. A device according to claim 1, wherein the electromagnetic lens or lenses are Rotman lenses.

* * * * *